US009683394B1

(12) United States Patent
Rickrode

(10) Patent No.: US 9,683,394 B1
(45) Date of Patent: Jun. 20, 2017

(54) SIMPLIFIED SYSTEM AND METHOD FOR SECURE SHIPMENT OF HIGH-VALUE CARGO

(71) Applicant: C. Joseph Rickrode, Nashua, NH (US)

(72) Inventor: C. Joseph Rickrode, Nashua, NH (US)

( * ) Notice: Subject to any disclaimer, the term of this patent is extended or adjusted under 35 U.S.C. 154(b) by 0 days.

(21) Appl. No.: 15/234,639

(22) Filed: Aug. 11, 2016

Related U.S. Application Data

(60) Provisional application No. 62/204,099, filed on Aug. 12, 2015.

(51) Int. Cl.

| | |
|---|---|
| ***E05B 83/02*** | (2014.01) |
| ***E05B 47/00*** | (2006.01) |
| ***E05B 77/44*** | (2014.01) |
| ***E05C 9/04*** | (2006.01) |
| ***E05C 9/02*** | (2006.01) |
| ***E05B 65/06*** | (2006.01) |
| ***E05C 7/00*** | (2006.01) |
| ***E05B 17/20*** | (2006.01) |
| ***G07C 9/00*** | (2006.01) |

(52) U.S. Cl.
CPC ..... *E05B 83/02* (2013.01); *E05B 17/20* (2013.01); *E05B 47/00* (2013.01); *E05B 65/06* (2013.01); *E05B 77/44* (2013.01); *E05C 7/00* (2013.01); *E05C 9/02* (2013.01); *E05C 9/04* (2013.01); *G07C 9/00309* (2013.01); *E05B 2047/0067* (2013.01)

(58) Field of Classification Search
CPC ..... E05B 81/06; E05B 81/40; E05B 83/02; E05B 81/82; E05B 85/22; E05B 39/00; E05B 39/005; E05B 47/0603; E05B 47/00; E05B 77/44; E05B 65/06; E05B 17/20; E05B 2047/0067; G07C 9/00309; E05C 9/04; E05C 9/02; E05C 7/00
USPC ..... 340/5.2, 5.72, 426.28, 5.8; 70/63
See application file for complete search history.

(56) References Cited

U.S. PATENT DOCUMENTS

| | | | | |
|---|---|---|---|---|
| 7,525,435 | B2 * | 4/2009 | Rickrode | B60R 25/24 340/5.7 |
| 8,069,693 | B2 * | 12/2011 | Powers | E05B 39/005 292/259 R |
| 8,441,336 | B2 * | 5/2013 | Rickrode | E05B 39/00 340/5.7 |
| 8,493,193 | B2 * | 7/2013 | Louis | E05B 81/06 340/425.5 |

* cited by examiner

*Primary Examiner* — Ali Neyzari
(74) *Attorney, Agent, or Firm* — Luis Figarella

(57) ABSTRACT

A simplified locking and mounting execution methods for protecting high-value cargo enclosed in a container, while maintaining the container indistinguishable from similar low value shipments, including an OnBoard Identity Module (OBIM) providing lock and unlock actuation activities for the Internal Locking Mechanism (ILM), both of which are externally undetectable. The OBIM interacts with a Securing Rod or similar securing feature which engages one or more container components in a manner preventing the container from being opened until a properly encoded unlocking signal is sent to the locking system via wireless methods from a remote point directing the OBIM to actuate again to unlock the container. This simplified locking mechanism provides components of a size suitable for repeated use, removal, transport, and reuse elsewhere over-and-over or cost effective solutions suitable for single use disposable applications.

20 Claims, 12 Drawing Sheets

2 OBIMs Secure Overlapping Door at Top & Bottom

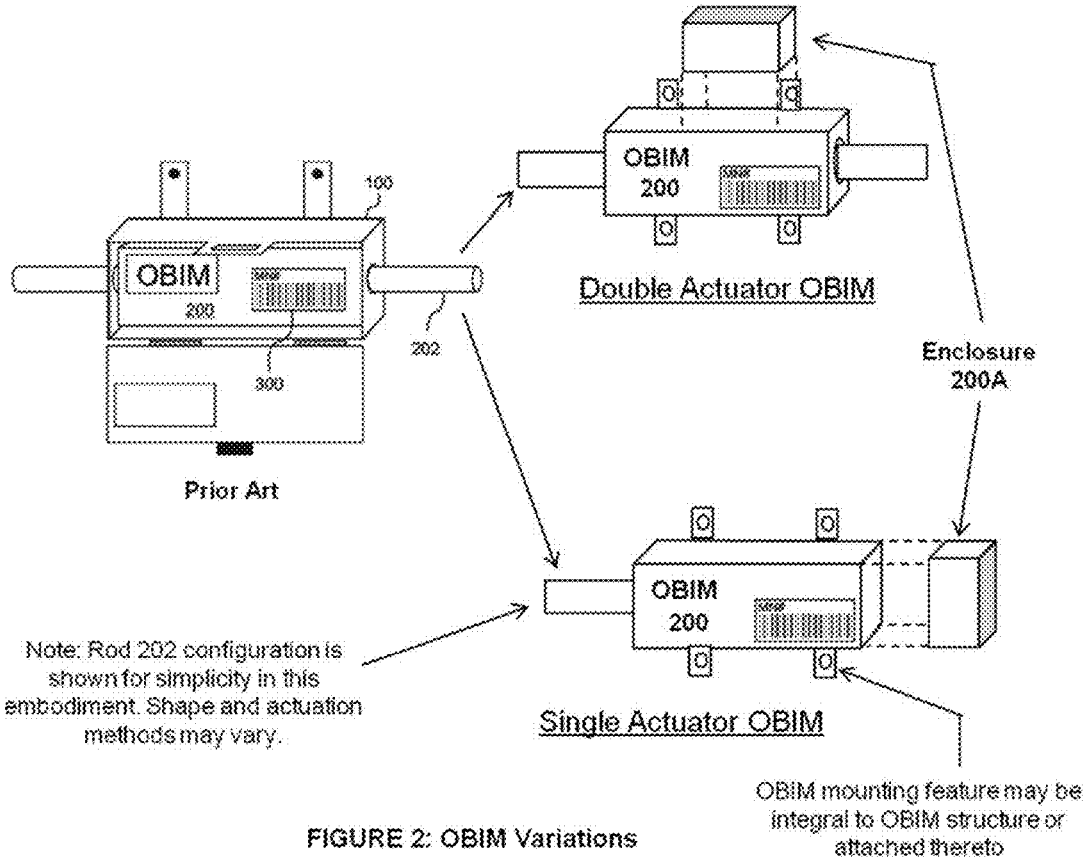
FIGURE 2: OBIM Variations

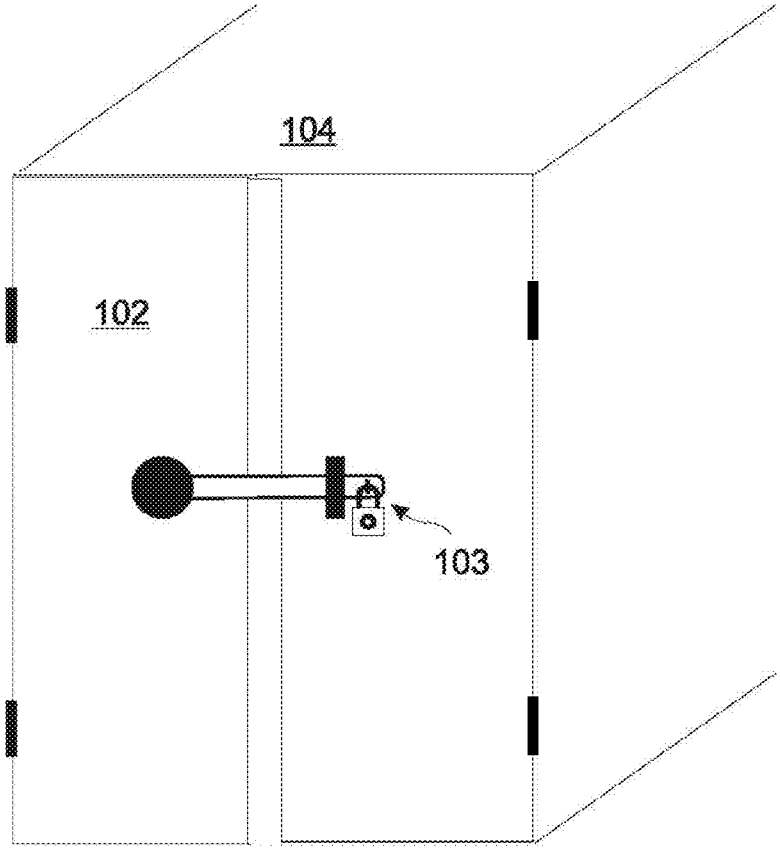
FIGURE 3: Typical Container External Locking Mechanism

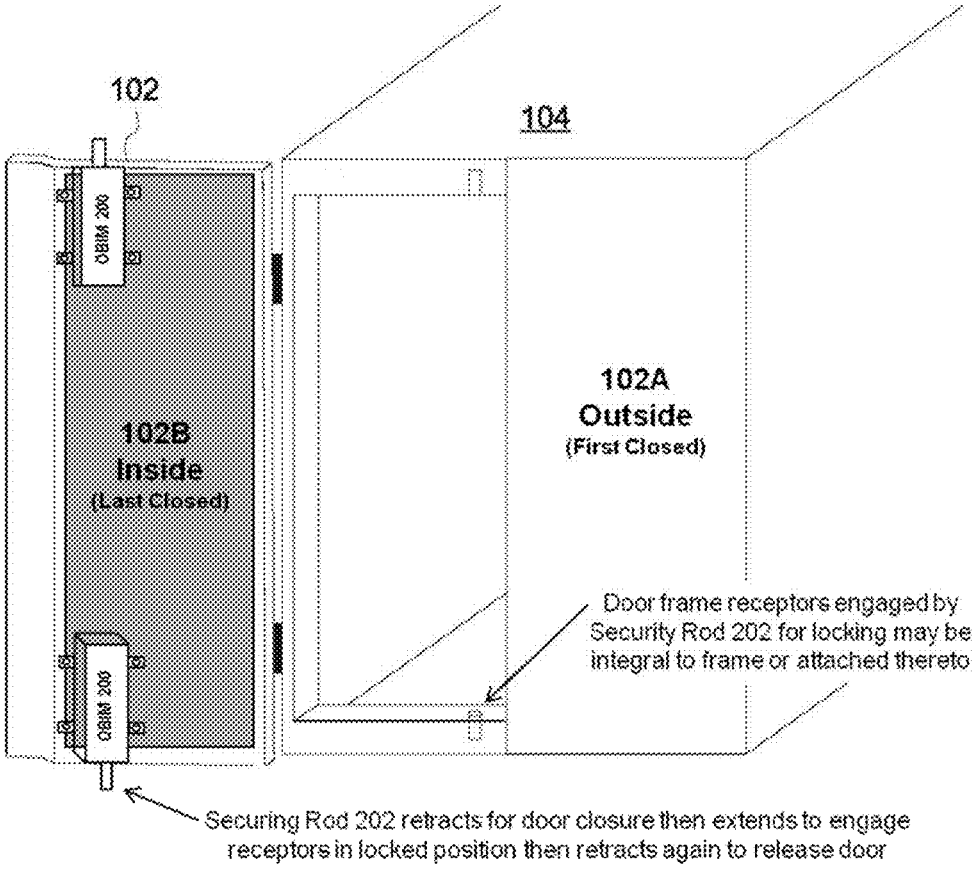
FIGURE 4: 2 OBIMs Secure Overlapping Door at Top & Bottom

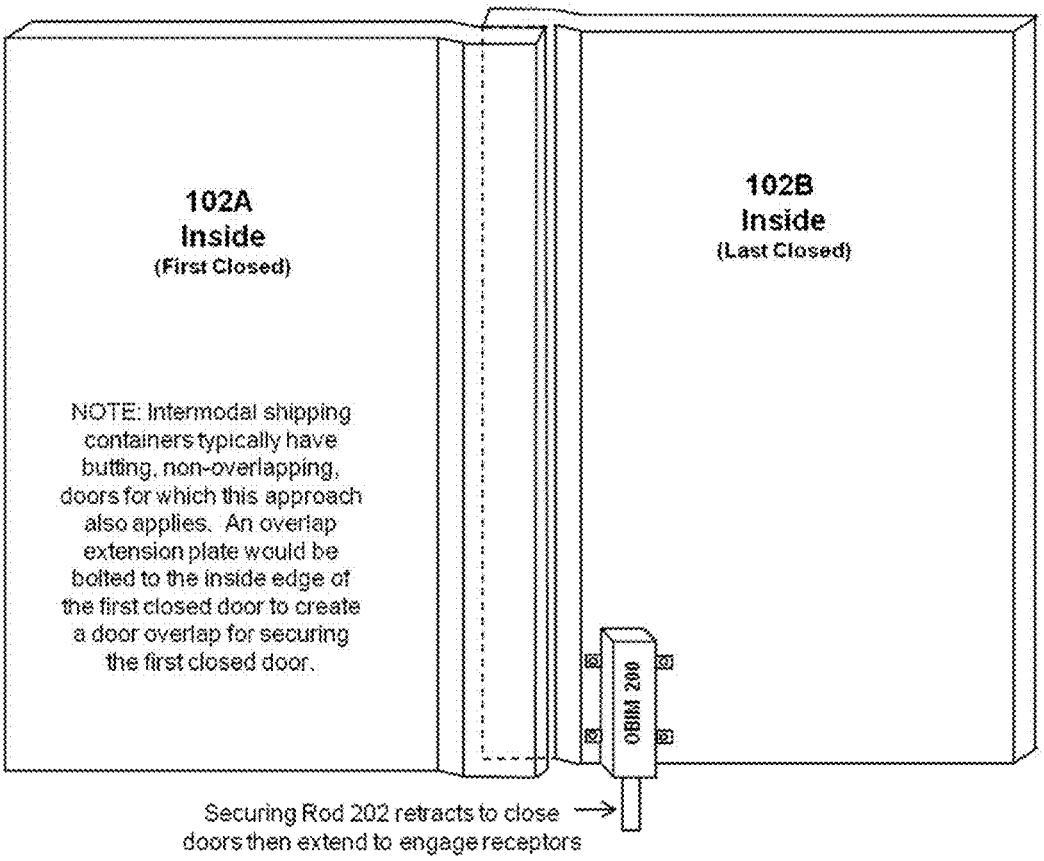
FIGURE 5: Single OBIM Only – Lowest Cost Blind Lock
(Lowest Security – One Door Locked to Frame Secures Both Doors)

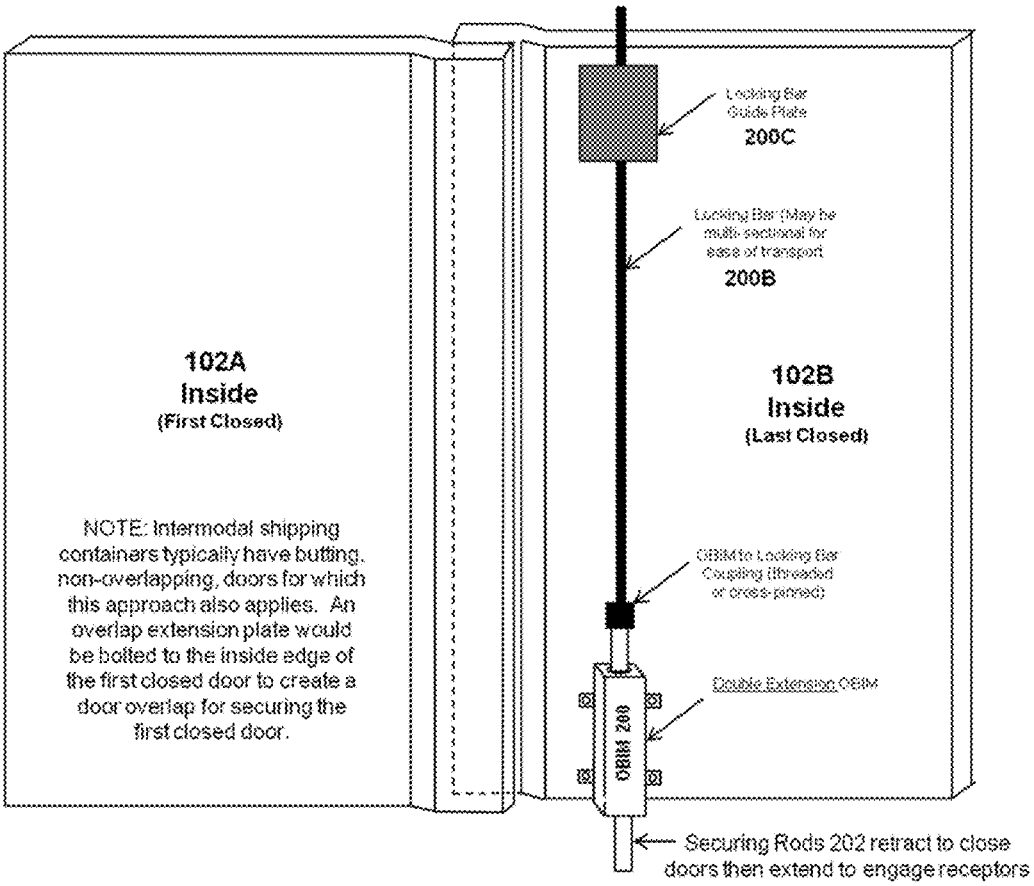
FIGURE 6: Single OBIM Lock + Extender Locking Bar

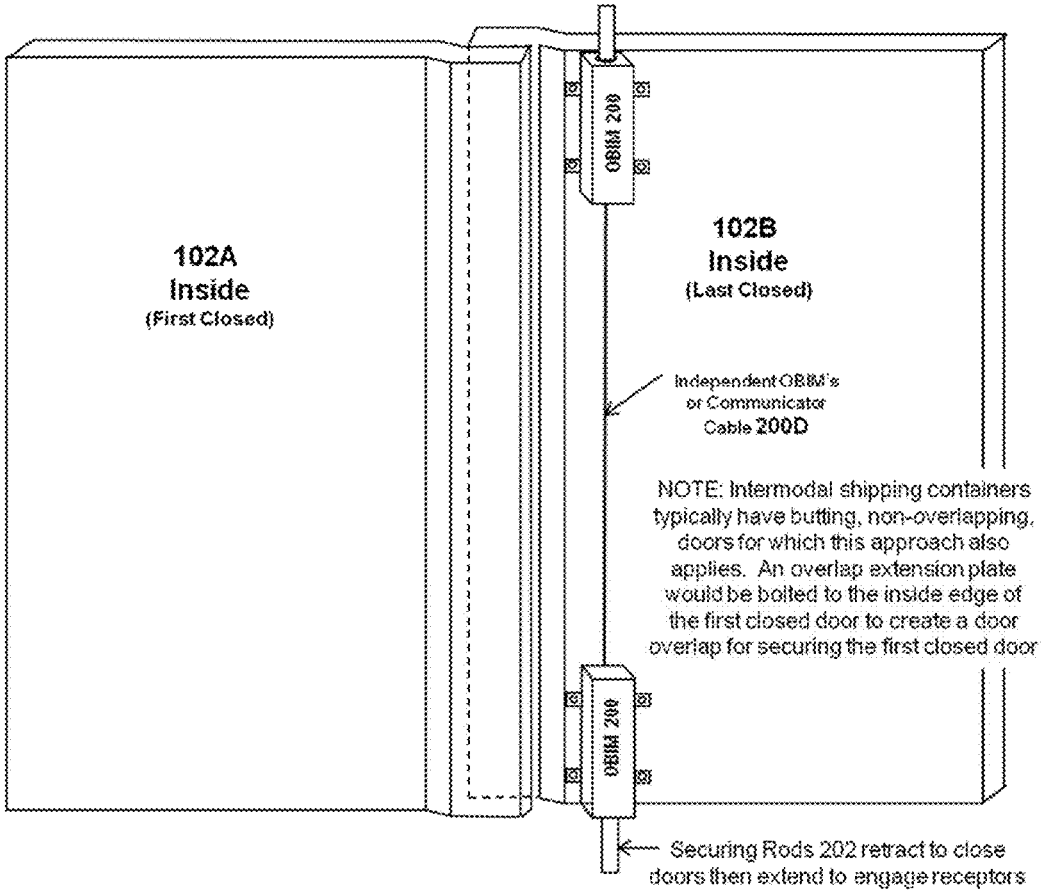
FIGURE 7: Dual OBIMs Lock Top & Bottom of Last Door

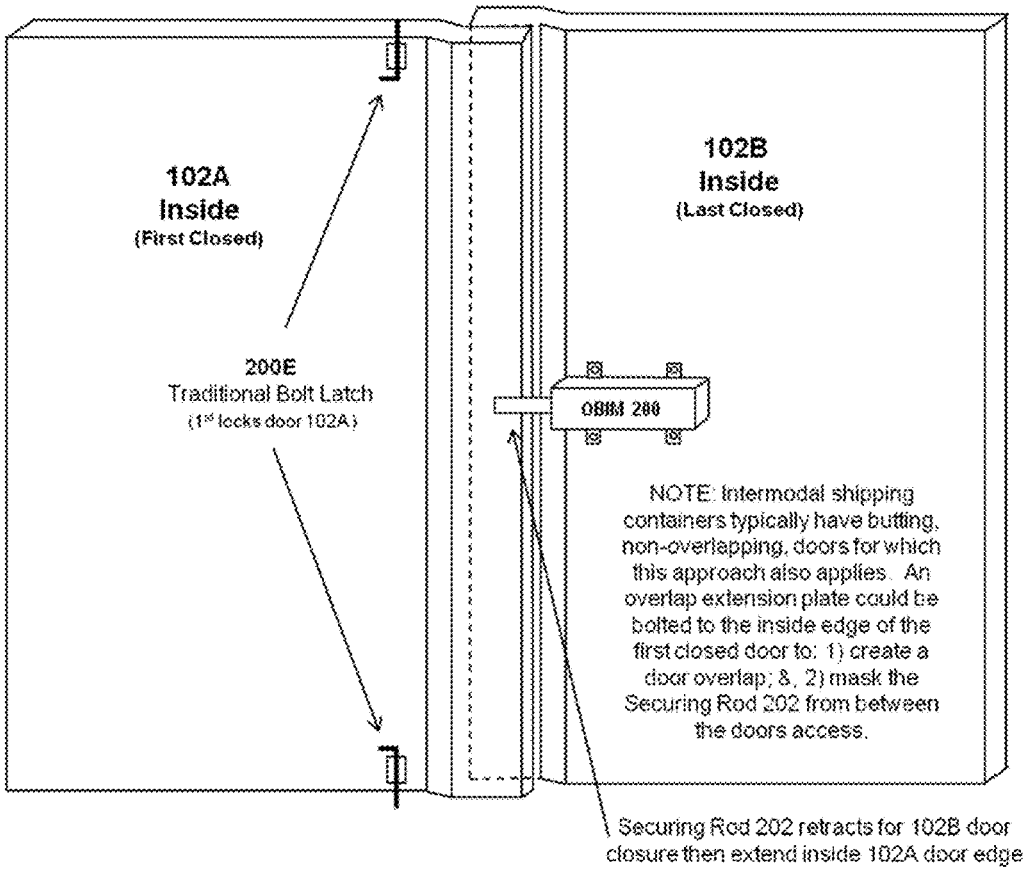
FIGURE 8: Single OBIM Lock + Two Bolt Latches

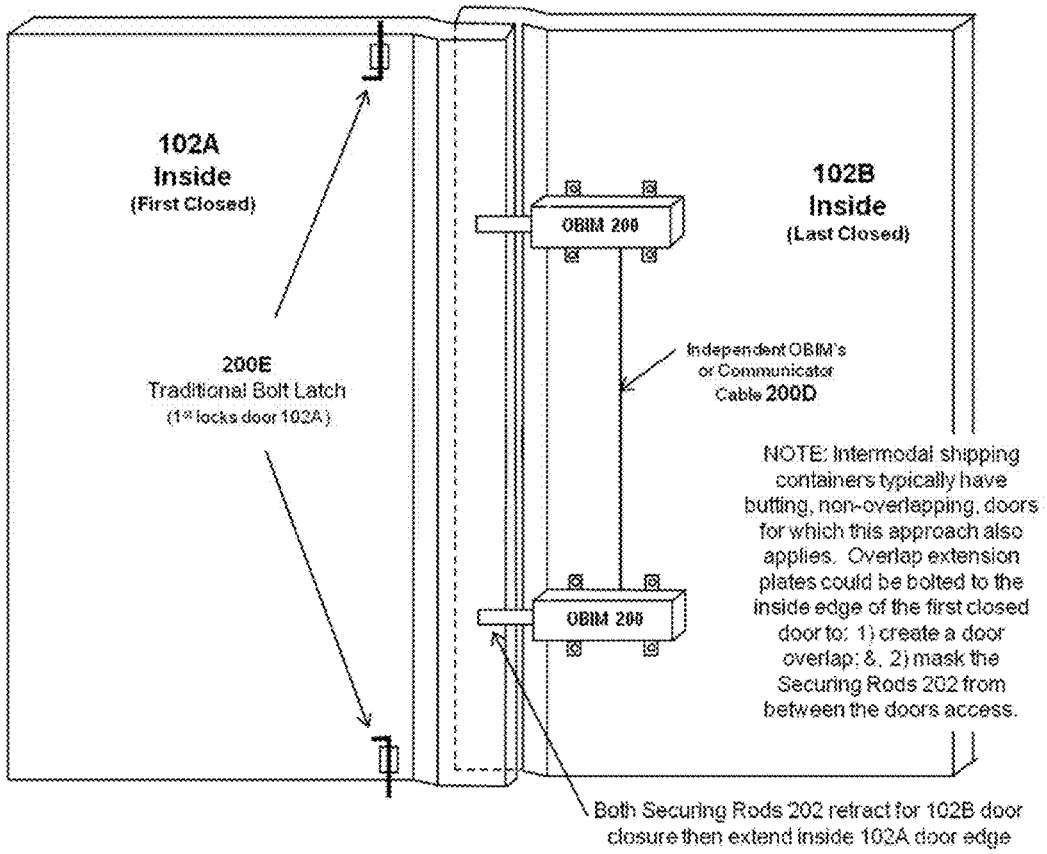
FIGURE 9: Dual OBIMs + Two Bolt Latches

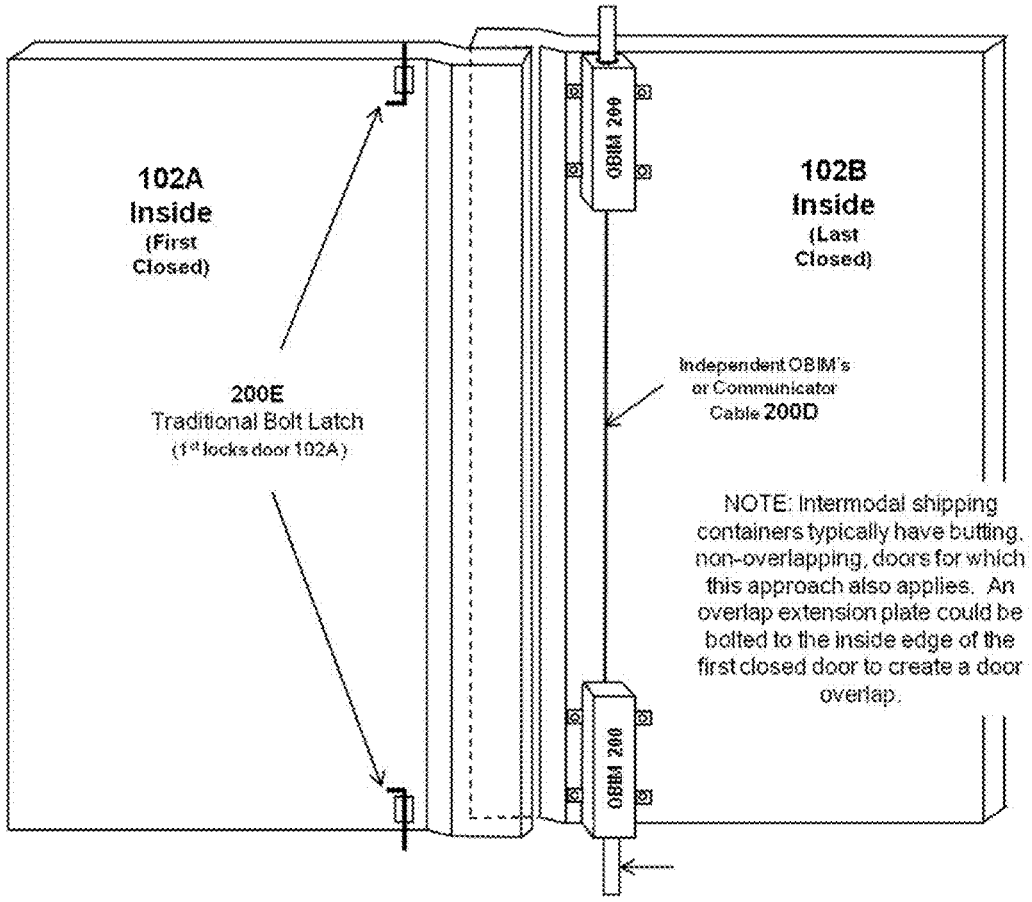
FIGURE 10: Dual OBIMs + Two Bolt Latches
(Highest Security – Each Door Locked to Frame)

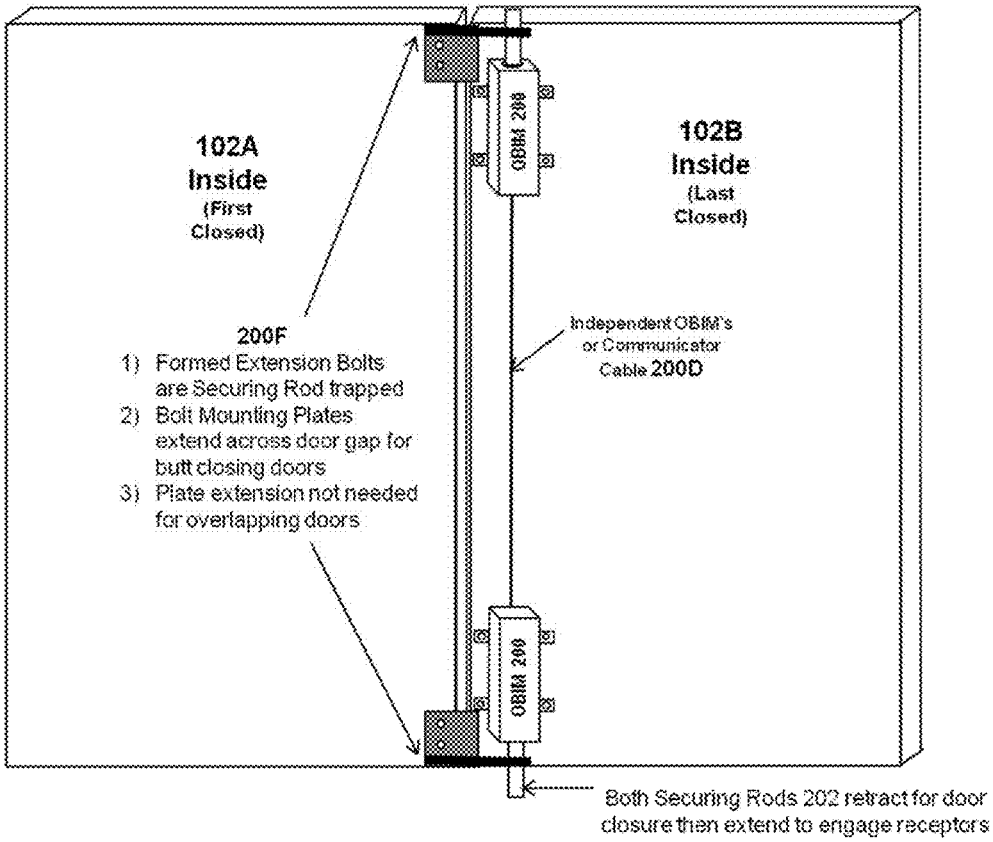
FIGURE 11: Dual OBIMs + Two Extension Bolts (top view of Door)

(top view of Door)

SIMPLIFIED SYSTEM AND METHOD FOR SECURE SHIPMENT OF HIGH-VALUE CARGO

CROSS-REFERENCE TO RELATED APPLICATIONS

This application claims priority to U.S. Provisional patent application Ser. No. 62/204,099 titled "A SIMPLIFIED SYSTEM AND METHOD FOR SECURE SHIPMENT OF HIGH-VALUE CARGO", filed on Aug. 12, 2016 the disclosure of which is herein incorporated by reference in its entirety.

PATENTS CITED

The following documents and references are incorporated by reference in their entirety, Rickrode (U.S. Pat. No. 8,493,193).

FIELD OF THE INVENTION

The invention relates to "simplified locking and mounting execution methods" for securing shipment of cargo, and more particularly to technologies for sustaining the security of cargo during shipment while utilizing "simplified, relatively small components".

DESCRIPTION OF THE RELATED ART

Security systems that are adaptable to a practical, cost effective "use, remove, transport, and reuse methodology" rather than employing costly stationary or semi-stationary execution components committed to the cargo vessel in which installed or alternately utilize removable but sizeable components not as conducive to cost effective transport and reuse as the concepts herein conveyed. The form factor presented herein is compatible with breaking down the locking system components to a toolbox sized "kit" allowing volumes of the kits to be collectively recycled rapidly in a cost effective manner. The form factor presented herein is compatible with breaking down the locking system components to a toolbox sized "kit" allowing volumes of the kits to be collectively recycled rapidly in a cost effective manner.

The simplified locking and mounting execution method described herein are intended to be totally compatible with and utilized in conjunction with U.S. Pat. No. 8,441,336 "System and Method for Secure Shipment of High-Value Cargo." Beyond the simplified components and mountings described and conveyed via supporting drawings herein, all other aspects should be drawn from the cited patent.

The need to protect cargo while in transit has existed since ancient times, but recent changes in the manner in which cargo is shipped, as well as a huge increase in the sheer volume of cargo which is shipped, has given rise to new and special challenges with regard to tracking and protecting such cargo.

In particular, cargo is often shipped in standardized movable enclosures variously referred to as "containers," which can be loaded at a point of origin, and then shipped to a destination via a combination of mobile entities including truck, rail, and sea transportation among others. Note that the term "mobile entity" and/or "movable enclosure" is used herein to denote any and all transportable entities, including self-powered vehicles such as autos and trucks as well as entities which are transported by auxiliary means and/or methods such as transporting trailers, cargo containers, cartons, skids, pallets, and such like. The entire journey can include as many as five or more transfers between carriers, as well as temporary storage at consolidation and/or distribution centers, before the container finally arrives at the destination.

Other present-day methods of shipping cargo include shipment by semi-trailer, enclosed truck, enclosed rail car; transportable tanker, and such like. It is common for a trailer or other container to be transferred between different carriers while en route. For example, a trailer may be pulled by more than one tractor, or may be carried during portions of its journey on a rail car, barge, or ship so as to achieve maximum transport efficiency and economy. Problems which can occur en route include theft of the entire container, a container break-in and theft of some or all of its contents, and containers getting lost, delayed, or diverted erroneously or intentionally.

A tracking system is sometimes used to keep track of a shipment while it is en route to its destination. One approach to tracking such shipments is to provide each container, truck, etc. with a unique, identifying number or code, which can be displayed for reading or scanning while en route. RFID tags can also be used for this purpose. As an alternative, an electronic tracking device can be included with the shipment, whereby the tracking device uses wireless communication to report its location, both to monitoring stations and/or while in route using cell phone or similar technology.

While these present-day shipping methods can be very efficient, they present special challenges regarding how to maintain the security of cargo during transit and protect it against tampering, theft, and such like. High-value cargo presents special security challenges while en route, since it is likely to be singled out and targeted by thieves, vandals, and/or other persons wishing to interfere with the cargo's delivery, and/or to steal it.

The traditional approach to protecting high-value cargo is to provide special encasement, surveillance, and even guards. An example would be an armored car transporting cash between banks. However, while these approaches can provide additional protection against thieves, vandals, terrorists, and such like, they also tend to be very expensive. And unless the level of protection is very strong, these high security approaches can actually do more harm than good, since they serve to draw attention to the high-value cargo, and provide a very recognizable target for thieves, vandals, and other potential threats.

On the other hand, if high-value cargo is shipped without special protection, it can be highly vulnerable to tampering and theft. In particular, if a shipment tracking system is included, as is often the case for high-value cargo so as to mitigate the risk of loss due to accidental misdirection, the tracking system can actually serve to increase the danger that the high-value cargo will be singled out and stolen, vandalized, or otherwise hindered or tampered with.

In particular, someone with access to shipping paperwork may accept a bribe from a thief to provide a tracking number for an especially valuable shipment, and may even cooperate further by accessing the tracking system and providing location information to the thief. Or a sophisticated thief may find a way to gain unauthorized access to a tracking system, for example by intercepting wireless communications between monitoring stations and the shipment, and then use the information to track and locate the high-value shipment for the purpose of intercepting it.

What is needed, therefore, is a system for increasing the security of high value cargo while en route, without providing a mechanism for a potential threat to identify, locate, track and/or intercept the cargo.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect, the invention is an undetectable locking system for securing defined points of entry to a movable enclosure interior, said system comprising an Internal Locking Mechanism (ILM) configured to prevent opening of said movable enclosure's one or more defined points of entry when said movable enclosure's point of entry is closed and said ILM is in its locked position, wherein the ILM is externally undetectable and inaccessible when said movable enclosure's point of entry is closed, an OnBoard Identity Module (OBIM) which provides said ILM actuation which secures or releases one or more point of entry securing features, with each said securing feature release being inhibited when the ILM is activated and enabled when the ILM is released, said OBIM being configured to respond to commands originating from wireless communication with external nodes when the OBIM is positioned within the closed movable enclosure, said locking system being able to wirelessly receive, electronically store and process instructions plus provide responses to the external nodes queries and a Base Unit providing a collection point for electronic components enabling control of said OBIM from external nodes and providing two-way communication and/or monitoring functions as deemed appropriate. In another aspect, said movable enclosure point of entry is comprised of one or more from a list consisting of: door, roll-up door, personnel door, hatch, swing door and/or trailer door; and said securing feature is comprised of one or more of from the list consisting of: rod, bar, pole, shaft, stick, dowel, hook, screw, barb, bayonet and/or crab claw. In yet another aspect, a plurality of possible OBIM configurations, each of said OBIMs including or accepting an attachment configuration which is compatible with the plurality of OBIMs, said attachment configurations being configured so that for each of a plurality of movable enclosure's geometric configurations at least one of the OBIMs is attachable thereto, all of the plurality of OBIMs having an adaptable configuration compatible with a plurality of applications.

In another aspect, a plurality of possible securing feature configurations, each of said securing features including an attachment configuration which is compatible with an OBIM actuator configuration, said securing feature configurations being configured so that for each of a plurality of movable enclosure's geometric configurations at least one of the Securing Rod configurations is adaptable in a manner to provide secure movable enclosure locking. In yet another aspect, all movable enclosure access elements are secured by an ILM (OBIM plus securing feature) or other suitable methods to prevent defeating said ILM by other means. In another aspect, each said ILM includes a secure receptor configuration for the engaging of said securing feature element to positively engage for securing the access point locking component, wherein said securing feature can be mounted on either the movable or stationary portion of said movable enclosure access point. In yet another aspect, multiple ILM assemblies locking a movable enclosure can be collectively or individually controlled. In another aspect, key ILM components are configured such that rapid, secure mounting in multiple movable enclosure configurations is possible plus potential removal for reuse is provide for. In yet another aspect, a flexible design provides for either local or remote non-contact status control of movable enclosure mounted ILMs and/or monitoring or both.

In one aspect, the invention is about a method for the undetectable locking and securing of defined points of entry to a movable enclosure interior, said method comprising providing an Internal Locking Mechanism (ILM) configured to prevent opening of said movable enclosure one or more defined points of entry when said movable enclosure's point of entry is closed and said ILM is in its locked position, wherein the ILM is externally undetectable and inaccessible when said movable enclosure's point of entry is closed, providing an OnBoard Identity Module (OBIM) which provides said ILM actuation which secures or releases one or more point of entry securing features, with each said securing feature release being inhibited when the ILM is activated and enabled when the ILM is released, said OBIM being configured to respond to commands originating from wireless communication with external nodes when the OBIM is positioned within the closed movable enclosure, said locking system being able to wirelessly receive, electronically store and process instructions plus provide responses to the external nodes queries and providing a Base Unit providing a collection point for electronic components enabling control of said OBIM from external nodes and providing two-way communication and/or monitoring functions as deemed appropriate.

In one aspect, the invention is about a non-transitory computer-readable medium encoded with executable instructions that, when executed by a processor, cause the processor to perform a method for the undetectable locking and securing of defined points of entry to a movable enclosure interior, said method comprising providing an Internal Locking Mechanism (ILM) configured to prevent opening of said movable enclosure one or more defined points of entry when said movable enclosure's point of entry is closed and said ILM is in its locked position, wherein the ILM is externally undetectable and inaccessible when said movable enclosure's point of entry is closed, providing an OnBoard Identity Module (OBIM) which provides said ILM actuation which secures or releases one or more point of entry securing features, with each said securing feature release being inhibited when the ILM is activated and enabled when the ILM is released, said OBIM being configured to respond to commands originating from wireless communication with external nodes when the OBIM is positioned within the closed movable enclosure, said locking system being able to wirelessly receive, electronically store and process instructions plus provide responses to the external nodes queries and providing a Base Unit providing a collection point for electronic components enabling control of said OBIM from external nodes and providing two-way communication and/or monitoring functions as deemed appropriate.

Other features and advantages of the present invention will become apparent upon examining the following detailed description of an embodiment thereof, taken in conjunction with the attached drawings.

BRIEF DESCRIPTION OF THE DRAWINGS

FIG. 2 shows OBIM variations, according to an illustrative embodiment of the invention.

FIG. 3 shows Typical Container External Locking Mechanisms, according to an illustrative embodiment of the invention.

FIG. 4 shows two OBIMs Securing an Overlapping Door at Top & Bottom, according to an illustrative embodiment of the invention.

FIG. 5 shows a Single OBIM Only—Lowest Cost Blind Lock, according to an illustrative embodiment of the invention.

FIG. 6 shows a Single OBIM Lock+Extender Locking Bar, according to an illustrative embodiment of the invention.

FIG. 7 shows a Dual OBIMs Lock Top & Bottom of Last Door closed, according to an illustrative embodiment of the invention.

FIG. 8 shows a Single OBIM Lock+Two Manual Bolt Latches, according to an illustrative embodiment of the invention.

FIG. 9 shows Dual OBIMs+Two Manual Bolt Latches, according to an illustrative embodiment of the invention.

FIG. 10 shows Dual OBIMs+Two Manual Bolt Latches with (Highest Security—Each Door Locked to Frame), according to an illustrative embodiment of the invention.

FIG. 11 shows Dual OBIMs+Two Extension Bolts providing High Security where Manual Bolts are not desired yet both doors are OBIM locked into a frame anchoring, according to an illustrative embodiment of the invention.

Figure 1A:
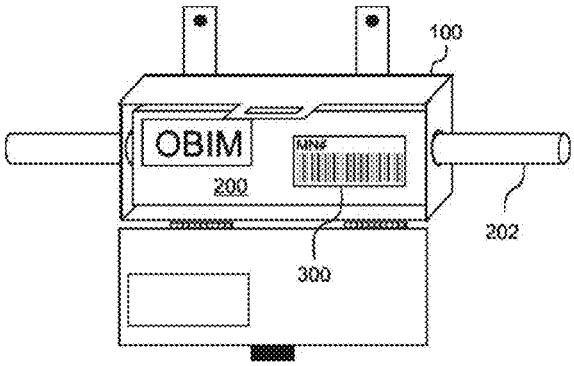
Figure 1A Prior Art
FIGS. 1A-1B show key functional concepts in the prior art, according to illustrative embodiments of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

The present invention is a system for providing cost effective increased security for high-value cargo while simultaneously preserving the natural protection which arises due to the shipment being externally totally indistinguishable, i.e., "hiding in plain sight" from the large majority of similar containers which are likely not carrying high value cargo appearing to be just another grain of sand on a beach.

In general, we refer to a system and method for securing and/or preventing unauthorized access/entry to the access points (including but not limited to regular doors, roll-up doors, personnel doors, hatch, swing door trailer doors and the like) for movable enclosures used to transport goods or similar items. When referring to said movable enclosures, we include to any enclosure such as cargo containers, as well as any typically solid, contained volume such as that in cargo containers, enclosed trucks, semi-trailers, air cargo containers, boxcar, tankers and the like.

Figure 1B:
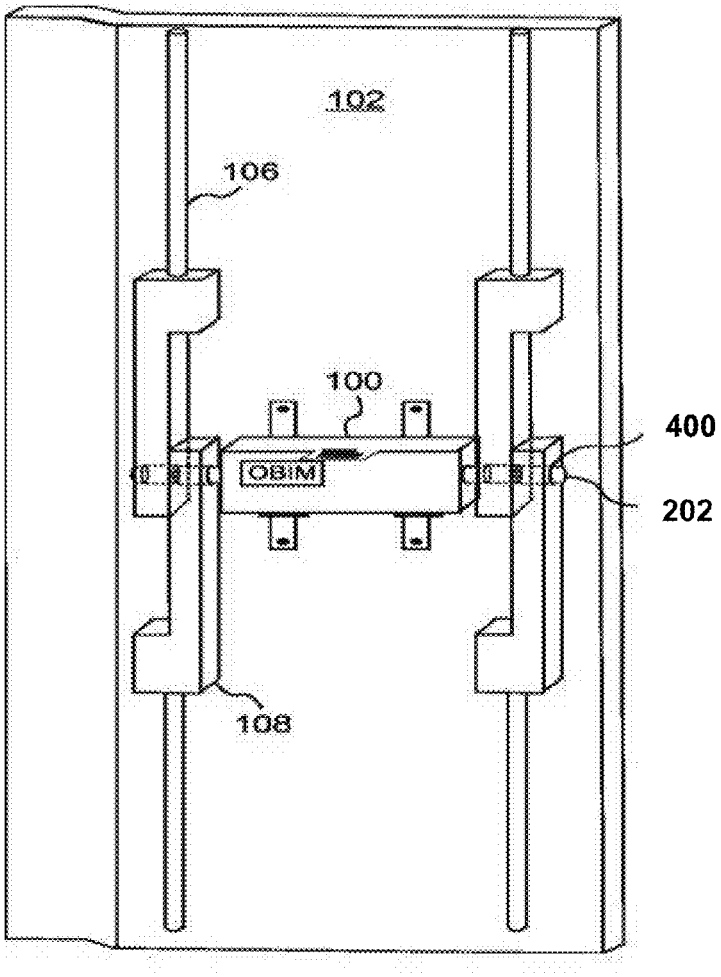
Figure 1B Prior Art
Figure 12:
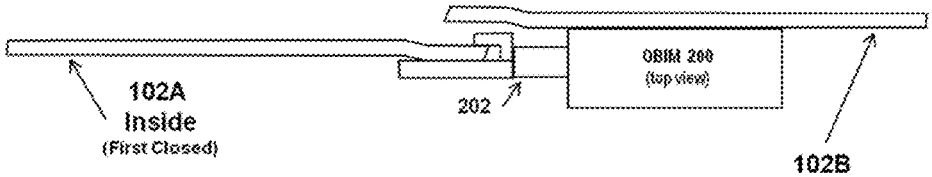
FIGS. 12-13 show varying views of a top view of the door when locked according to an illustrative embodiment of the invention.
Figure 13:
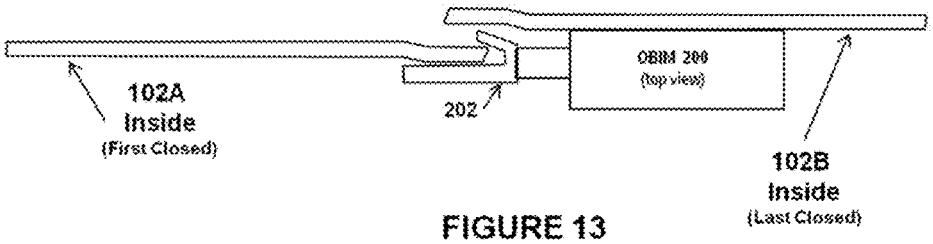

FIGS. 1A-1B show key functional concepts per the prior art per patent U.S. Pat. No. 8,441,336, further improved and carried forward in this application, which are the "focal points" for simplification herein. The "Simplified System" eliminates two of the Internal Locking Mechanism components 106 and 108, plus the Base Unit Housing 100. The simplified system defined herein utilizes a securing feature or Securing Rod 202 (which may be comprised of, but not limited to a rod, bar, pole, shaft, stick, dowel, pin, hook, screw, barb, bayonet, crab claw and the like) as the primary locking feature "actuated" by the OBIM 200 together composing the Internal Locking Mechanism (ILM).

FIG. 2 shows improvements composed of OBIM 200 and Securing Rod 202, no longer enclosed in Base Unit 100 housing on the left, and including on the right side both a single and double actuator OBIM 200 version where the mounting features are now included with the OBIM 200 configuration itself and the Base Unit Housing 100 is eliminated. NOTE: A separate OBIM attached or detached Enclosure 200A may be utilized for containing functionally related elements, etc.

Both the single or double actuator OBIM 200 configuration "could" utilize removable mounting features (straps, bolt plate, etc.) to allow flexible mounting alternatives for the OBIM 200 configuration, should user applications so dictate. OBIM 200 mounting feature may be integral to OBIM structure or attached thereto.

The Securing Rod 202 is the element actuated by the OBIM 200. Such actuation can include extension and retraction and/or rotation in either or both directions. In other embodiments, the Securing Rod 202 protrusion may be replaced by a cavity or socket like configuration which engages a stationary rod-like protrusion mounted elsewhere and aligned to engage said cavity/socket. A rod configuration is shown for simplicity. Securing feature shape and actuation methods may vary.

In some embodiments, the Securing Rod 202 may include "form" features such as but not limited to a ball end, threads, tapered end, bayonet mount, protruding lug, etc. intended to provide secure lock-up when in the engaged position and which is reversible or otherwise released to allow unlock. Such form features may be integral to the Securing Rod or attachable there to by suitable means. Any securing cavity/socket feature would be compatible with accepting such locking features while providing lock and unlock capability where needed, often referred to as male and female mating components.

Both the single or double Securing Rod 202 actuators on OBIM 200 configurations in FIG. 2 "could" utilize Enclosure 200A as an OBIM 200 attachment or detached and placed elsewhere for containing system function and control related elements. Enclosure 200A can provide for special needs such as hermetic sealing, firmware storage, vibration mounting, etc. The OBIM 200 with an attached Securing Rod 202 and any OBIM adaptive mounting components are collectively referred to as the Internal Locking Mechanism (ILM).

Referring to FIG. 3, this shows a typical Container 104 with its Container Doors 102 having a totally visible external generic Locking Mechanism 103. A plethora of external door locking hardware variations exist as well as electronic tags, some of which provide tamper signaling or tracking capability. All such offerings include VISIBLE characteristics. Some alternatives include locks built into the doors but have visible actuation geometry, power sockets, etc. on the exterior of Container Doors 102 indicating the presence of these features. Any and all extra visible security measures FLAG the container as potentially carrying high value cargo. All such clearly visible security features are generally removable with bolt cutters and the like or easily defeated due to their external Container Door 102 accessibility.

FIG. 4 introduces one embodiment of the herein proposed two ILM's each having a totally hidden OBIM 200 equipped with a Securing Rod 202 placed on the INSIDE wall of Container Door 102B with NO externally visible characteristics. In other embodiments, the securing rod, or alternate securing element, may be container frame/body mounted and mating locking receptor may be integral or attached to the door. The outside of the Container Doors 102 would likely be secured with simple locking features as shown in FIG. 3 so as not to call attention to the Container 104 or suggest it contained high value goods. Once this Container 104 has its last Container Door 102B closed overlapping the first door, the presence of the 2 ILMs is indistinguishable from similar containers secured by conventional means such that the container's contents appear to be of no particular value or uniqueness. NOTE: In alternate embodiments, securing feature, rod or other, may be container frame/body mounted and receptor may be integral or attached to door.

With its two ILMs, FIG. 4 likely conveys the probable well secured situation wherein two (2) "independent" OBIMs 200 are utilized such that the failure of one (1) would not defeat the second. This would likely be the "optimum" practical protection level where frequent and/or large numbers of high value shipments occur in containers designed with overlapping doors.

FIG. 5 shows the "simplest" embodiment utilizing a Single Actuator 200 OBIM with its integral mounting allowing direct attachment to inside of the last closed Container Door 102B. Note that this single point configuration provides the "total" locking for both container doors due to the final Container Door 102B overlap comprising the "lowest cost" ILM solution.

In the FIG. 5 mounting configuration, the Securing Rod 202 from the 200 OBIM would engage a complementary, mating configuration either in the container floor or in a plate mounted thereupon, or a floor mounted raised feature such that the ILM would pass over configuration provided then Securing Rod 202 would extend to ensure the door cannot be opened until the Securing Rod 202 is retracted.

FIG. 5 through FIG. 10 include notes specific to containers with non-overlapping doors. Intermodal shipping containers, also called seagoing or ocean containers, typically have butting, non-overlapping, doors for which the approaches conveyed herein also apply. Where and as appropriate, an overlap extension plate(s) would/could be bolted to the inside edge of the first closed door to create a door overlap; and, where applicable, mask the Securing Rod 202 from between the doors access and preventing a ready access for defeating the locking member.

FIG. 6 provides improved locking security by utilizing a Double Actuator OBIM 200 to provide direct locking per FIG. 5 but also extends an "attached" Locking Rod 200B for securing the top of the door via a similar engaging or interference feature. This Locking Bar 200B is secured by suitable means to the Securing Rod 202 of the OBIM 200 actuator to ensure both extension and retraction consistent with the ILM activities;

The Locking Rod 200B in FIG. 6 includes an upper door Locking Bar Guide Plate 200C which might likely utilize a door mounting pattern compatible with attaching a second OBIM 200 as conveyed in FIG. 7.

FIG. 7 utilizes two (2) ILMs providing DUAL positive lock points on a single door, thus increasing ultimate door security. In this dual configuration, the two (2) OBIMs 200 could be coupled together by an interconnecting Communicator Cable 200D or operated totally separately for added security;

FIG. 8 provides the "lowest cost" execution for positively securing both doors while utilizing only one (1) ILM. The use of two (2) stealthy, simple (barn door style) Bolt Latches 200E (with locking) provides secure closure of the first Container Door 102A which provides secure engagement for the Securing Rod 202 in the ILMs mounted to the final closing Container Door 102B.

FIG. 9 is identical to FIG. 8 except for the additional security provided by the use of two (2) ILMs providing upper and lower door side edge engaging stability and security to the second Container Door 102B lockup. As with FIG. 7, this dual configuration of two (2) OBIMs 200 could be coupled together by an interconnecting Communicator Cable 200D or operated separately for added security.

FIG. 10 provides the lowest cost "ultimate" door security with the use of two (2) stealthy, simple (barn door style) Bolt Latches 200E (with locking) to provide secured closure of the first door plus the addition of two (2) ILM's with Securing Rods 202 which separately engage the top and bottom of the Container 104. As with FIGS. 7 and 9, this dual configuration of two (2) ILMs could be coupled together by an interconnecting 200D Communicator Cable or operated separately for added security.

FIG. 11 provides the highest practical and cost effective approach for securing intermodal shipping containers and others where the doors butt to one another rather than overlap by preventing access to all securing rods. In such container, the doors close against sill and header plates which prevent access to all securing bolt and rod features.

FIG. 11 provides lowest cost "near ultimate" door security with the use of two (2) stealthy Extension Bolts 200F mountings secured to the first door then trapped inside the Securing Rods 202 of the (2) ILM's mounted on the last closed door 102B where the Security Rods engage the top and bottom of the Container 104. As with FIGS. 7, 9 and 10, this dual configuration of two (2) ILMs could be coupled together by an interconnecting 200D Communicator Cable or operated separately for added security.

The highest level of security would result from each door having two (2) or more ILM's each and controlled by a separate encoded unlocking signal for each ILM sent to specific targeted OBIM's via remote wireless methods.

With reference to FIG. 7, the system includes a secure Internal Locking Mechanism ("ILM") composed of two (2) OBIMs 200 each with a Securing Rod 202 which securely locks the cargo Container Door 102B, the ILM being configured so as not to be externally perceptible when the container is closed. The OBIMs 200 controlling Securing Rods 202 are configured to secure the ILM system so as to prevent it from being unlocked until proper unlocking authorization is wirelessly received by the OBIMs 200.

In embodiments, a common type of OBIM 200 can be used for protecting many different types of cargo containers 104 by providing a variety of different OBIM mounting configuration solutions, per FIG. 4-12, to a multitude of containers 104 configurations where differing levels of security may be applicable, all utilizing the same basic OBIM 200. FIG. 7 shows two (2) OBIMs 200 mounted to an interior surface of a Container Door 102 of a cargo Container 104 with overlapping doors. In this embodiment, the OBIMs are interlocking with the Container 104 door frame as cited in FIG. 4 and can be either independently controlled or controlled together if a Communicator Cable 200D is utilized.

Although not indicated in the graphic details of FIGS. 3-4, the ILM locking solution is supplemental to the conventional latching mechanism 103, so that only after the OBIMs 200 disengage Securing Rods 202 can the door be operated by release of the external lever of the conventional latching mechanism 103. In all cases, all OBIMs 200 must disengage all Securing Rods 202 for ultimate unlock such that the container can be opened.

FIG. 2 on the right side shows Security Rods 202 protruding from the sides of the OBIM 200. FIG. 4 describes how the Securing Rods 202 retract for clearing the door openings of Container 104 (or other mating locking configuration) then, when the Container Door 102B is fully closed, provide positive engagement of the Securing Rods 202 in the locking receptors in the Container 104 door frame (or similar securing feature depending on configuration). In all configurations, the OBIM secures the ILM system entirely by mechanical means and totally undetectable from the outside after closing the Container Door 102.

After the cargo has been secured within the Container 104 per one of the configurations conveyed in FIGS. 4-12 or a variation thereof, wireless communication is established between the ILM, primarily the OBIM 200, and the Security Management System (SMS) using Base Unit communications. Where remote monitoring is utilized, the SMS is the interacting command center which sends any and all activity signals through Base Unit controls to the ILM system plus verifies and confirms the OBIMs are signaling there present status such as secure lockup or other as appropriate.

Low cost disposable ILM configurations may utilize totally mechanical actuation for locking the Securing Rods 202. In such applications, wireless communication might potentially only be utilized for unlocking Securing Rods 202. Remote SMS monitoring may or may not be utilized in the low cost designs.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. An undetectable locking system for securing defined points of entry to a movable enclosure interior, said system comprising:

an Internal Locking Mechanism (ILM) configured to prevent opening of said movable enclosure's one or more defined points of entry when said movable enclosure's point of entry is closed and said ILM is in its locked position, wherein the ILM is externally undetectable and inaccessible when said movable enclosure's point of entry is closed;

an OnBoard Identity Module (OBIM) which provides said ILM actuation which secures or releases one or more point of entry securing features, with each said securing feature release being inhibited when the ILM is activated and enabled when the ILM is released, said OBIM being configured to respond to commands originating from wireless communication with external nodes when the OBIM is positioned within the closed movable enclosure, said locking system being able to wirelessly receive, electronically store and process instructions plus provide responses to the external nodes queries; and a Base Unit providing a collection point for electronic components enabling control of said OBIM from external nodes and providing two-way communication or monitoring functions as deemed appropriate.

2. The system of claim 1, wherein:

said movable enclosure point of entry is comprised of one or more from a list consisting of: door, roll-up door, personnel door, hatch, swing door trailer door or similar; and said securing feature is comprised of one or more of from the list consisting of: rod, bar, pole, shaft, stick, dowel, hook, screw, barb, bayonet, crab claw or similar.

3. The system of claim 2, further comprising:

a plurality of possible OBIM configurations, each of said OBIMs including or accepting an attachment configuration which is compatible with the plurality of OBIMs, said attachment configurations being configured so that for each of a plurality of movable enclosure's geometric configurations at least one of the OBIMs is attachable thereto, all of the plurality of OBIMs having an adaptable configuration compatible with a plurality of applications.

4. The system of claim 2, further comprising:

a plurality of possible securing feature configurations, each of said securing features including an attachment configuration which is compatible with an OBIM actuator configuration, said securing feature configurations being configured so that for each of a plurality of movable enclosure's geometric configurations at least one of the Securing Rod configurations is adaptable in a manner to provide secure movable enclosure locking.

5. The system of claim 2 wherein:

all movable enclosure access elements are secured by an ILM (OBIM plus securing feature) or other suitable methods to prevent defeating said ILM by other means.

6. The system of claim 2 wherein;

each said ILM includes a secure receptor configuration for the engaging of said securing feature element to positively engage for securing the access point locking component, wherein said securing feature can be mounted on either the movable or stationary portion of said movable enclosure access point.

7. The system of claim 2 wherein;

multiple ILM assemblies locking a movable enclosure can be collectively or individually controlled.

8. The system of claim 2 wherein:

key ILM components are configured such that rapid, secure mounting in multiple movable enclosure configurations is possible plus potential removal for reuse is provide for.

9. The system of claim 2 wherein:

a flexible design provides for either local or remote non-contact status control of movable enclosure mounted ILMs or monitoring or both.

10. A method for the undetectable locking and securing of defined points of entry to a movable enclosure interior, said method comprising:

providing an Internal Locking Mechanism (ILM) configured to prevent opening of said movable enclosure one or more defined points of entry when said movable enclosure's point of entry is closed and said ILM is in its locked position, wherein the ILM is externally undetectable and inaccessible when said movable enclosure's point of entry is closed;

providing an OnBoard Identity Module (OBIM) which provides said ILM actuation which secures or releases one or more point of entry securing features, with each said securing feature release being inhibited when the ILM is activated and enabled when the ILM is released, said OBIM being configured to respond to commands originating from wireless communication with external nodes when the OBIM is positioned within the closed movable enclosure, said locking system being able to wirelessly receive, electronically store and process instructions plus provide responses to the external nodes queries; and providing a Base Unit providing a collection point for electronic components enabling control of said OBIM from external nodes and providing two-way communication or monitoring functions as deemed appropriate.

11. The method of claim 10, wherein:

said movable enclosure point of entry is comprised of one or more from a list consisting of: door, roll-up door, personnel door, hatch, swing door, trailer door or similar; and said securing feature is comprised of one or more of from the list consisting of: rod, bar, pole, shaft, stick, dowel, hook, screw, barb, bayonet, crab claw or similar.

12. The method of claim 11, wherein:

a plurality of possible OBIM configurations, each of said OBIMs including or accepting an attachment configuration which is compatible with the plurality of OBIMs, said attachment configurations being configured so that for each of a plurality of movable enclosure geometric configurations at least one of the OBIMs is attachable thereto, all of the plurality of OBIMs having an adaptable configuration compatible with a plurality of applications.

13. The method of claim 11, wherein:

a plurality of possible securing feature configurations, each of said securing features including an attachment configuration which is compatible with an OBIM actuator configuration, said securing feature configurations being configured so that for each of a plurality of movable enclosure geometric configurations at least one of the Securing Rod configurations is adaptable in a manner to provide secure movable enclosure locking.

14. The method of claim 11, wherein:

all movable enclosure access elements are secured by an ILM (OBIM plus securing feature) or other suitable methods to prevent defeating said ILM by other means.

15. The method of claim 11, wherein:

each said ILM includes a secure receptor configuration for the engaging of said securing feature element to positively engage for securing the access point locking component, wherein said securing feature can be mounted on either the movable or stationary portion of said movable enclosure access point.

16. The method of claim 11, wherein:

multiple ILM assemblies locking a movable enclosure can be collectively or individually controlled.

17. The method of claim 11, wherein:

key ILM components are configured such that rapid, secure mounting in multiple movable enclosure configurations is possible plus potential removal for reuse is provide for.

18. The method of claim 11, wherein:

a flexible design provides for either local or remote non-contact status control of movable enclosure mounted ILMs or monitoring or both.

19. A non-transitory computer-readable medium embodying a program executable in at least one computing device, the program when executed, causing the at least one computing device to execute a method, said method comprising:

providing an Internal Locking Mechanism (ILM) configured to prevent opening of said movable enclosure one or more defined points of entry when said movable enclosure's point of entry is closed and said ILM is in its locked position, wherein the ILM is externally undetectable and inaccessible when said movable enclosure's point of entry is closed;

providing an OnBoard Identity Module (OBIM) which provides said ILM actuation which secures or releases one or more point of entry securing features, with each said securing feature release being inhibited when the ILM is activated and enabled when the ILM is released, said OBIM being configured to respond to commands originating from wireless communication with external nodes when the OBIM is positioned within the closed movable enclosure, said locking system being able to wirelessly receive, electronically store and process instructions plus provide responses to the external nodes queries; and providing a Base Unit providing a collection point for electronic components enabling control of said OBIM from external nodes and providing two-way communication or monitoring functions as deemed appropriate.

20. The non-transitory computer-readable medium of claim 19, wherein the method further comprises:

said movable enclosure point of entry is comprised of one or more from a list consisting of: door, roll-up door, personnel door, hatch, swing door, trailer door or similar; and said securing feature is comprised of one or more of from the list consisting of: rod, bar, pole, shaft, stick, dowel, hook, screw, barb, bayonet, crab claw or similar.

* * * * *